US006163995A

United States Patent [19]

Lucchetti et al.

[11] Patent Number: 6,163,995

[45] Date of Patent: Dec. 26, 2000

[54] EXPANDABLE ARTISTS' FRAMES AND PRELOADING SPRINGS THEREFOR

[76] Inventors: Walter Lucchetti, Via A. De Gasperi, 38, I-22070 Appiano Gentile, Italy; Carlo Zanella, Via Leonardo da Vinci, 12, I-22074 Lomazzo, Italy

[21] Appl. No.: 08/836,554

[22] PCT Filed: Nov. 14, 1995

[86] PCT No.: PCT/IB95/01005

§ 371 Date: May 19, 1997

§ 102(e) Date: May 19, 1997

[87] PCT Pub. No.: WO96/15915

PCT Pub. Date: May 30, 1996

[30] Foreign Application Priority Data

Nov. 17, 1994 [IT] Italy ..... C094A0022

[51] Int. Cl.[7] ..... G09F 17/00

[52] U.S. Cl. ..... 40/603; 40/741; 38/102.1

[58] Field of Search ..... 40/603, 604, 790, 40/792, 741, 742; 38/102.1, 102.4, 102.5, 102.7, 102.91; 160/374, 374.1, 378, 381

[56] References Cited

U.S. PATENT DOCUMENTS

| | | | |
|---|---|---|---|
| 80,135 | 7/1868 | Carroll | 160/374.1 |
| 159,012 | 1/1875 | Wright et al. | 160/374.1 |
| 339,276 | 4/1886 | Dodge | 160/374.1 |
| 996,915 | 7/1911 | Engelmohr | 40/783 X |
| 4,050,498 | 9/1977 | Lucchetti | 160/374.1 |
| 4,301,853 | 11/1981 | Vidal | 160/374.1 |

*Primary Examiner*—Brian K. Green
*Attorney, Agent, or Firm*—Young & Thompson

[57] ABSTRACT

An expandable artists' frame with preloading springs therefor, wherein the frame sides are slidably connected together at their ends by an optional groove-and-tongue joint or a hollow angular support and the preloading springs have a strip-like body with toothed ends. For mounting a spring, the latter is placed diagonally with its teeth against a frame corner or the internal surface thereof and then the spring is pushed manually toward the frame corner. During the spring application the spring teeth slide on the side internal surfaces. When stopping the thrust onto the spring, the teeth penetrate into the wooden side and exert a continuous preloading action on both adjacent frame sides. At the spring ends are preferably provided positioning and protection wings.

10 Claims, 6 Drawing Sheets

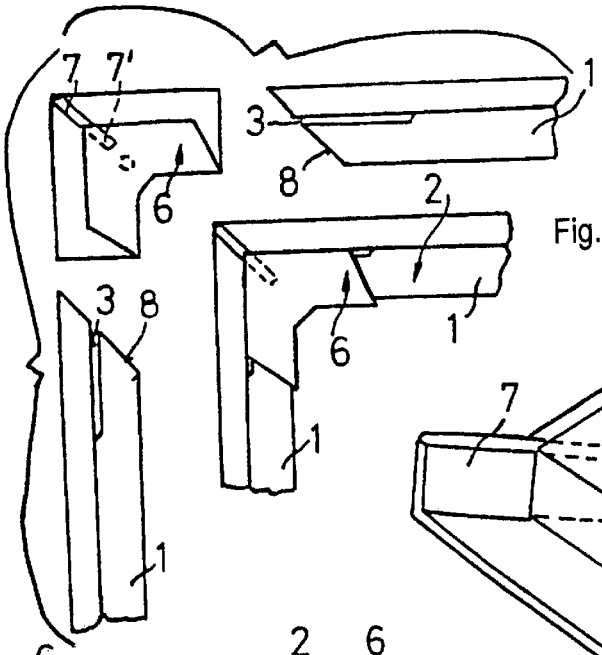
Fig. 1a Prior Art
Fig. 1b Prior Art
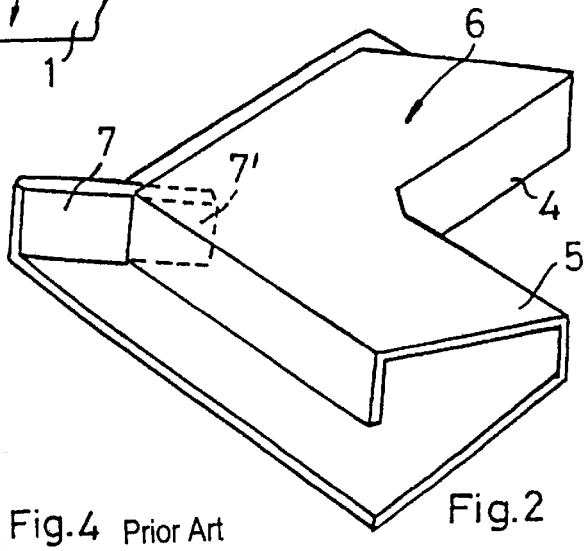
Fig.2
Prior Art
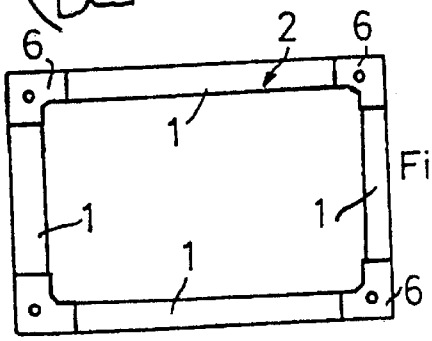
Fig.4 Prior Art
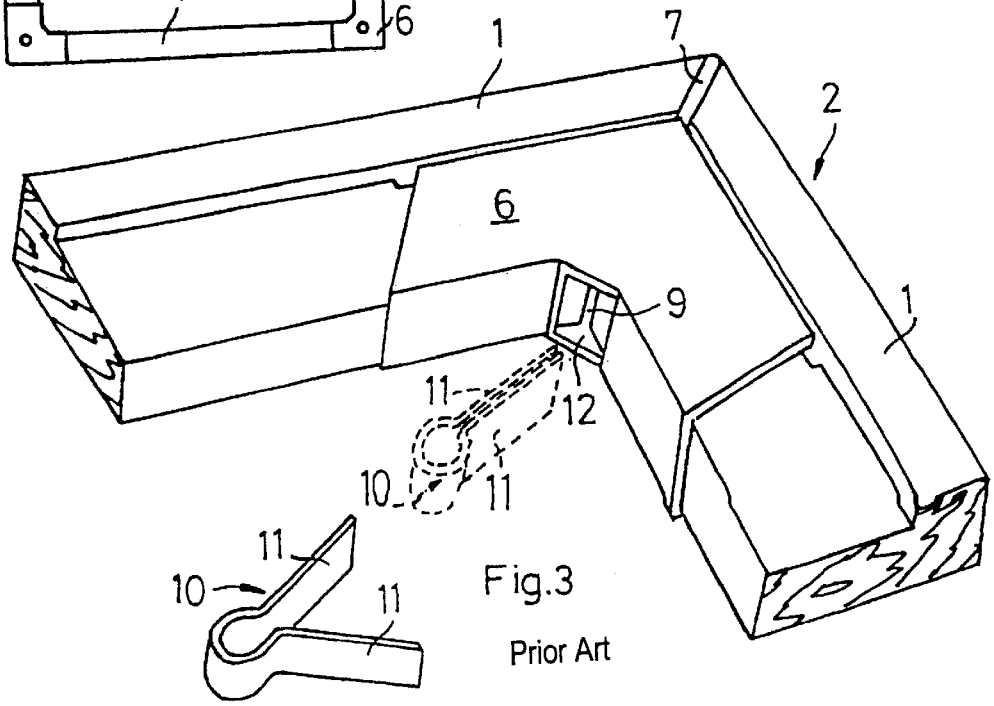
Fig.3
Prior Art

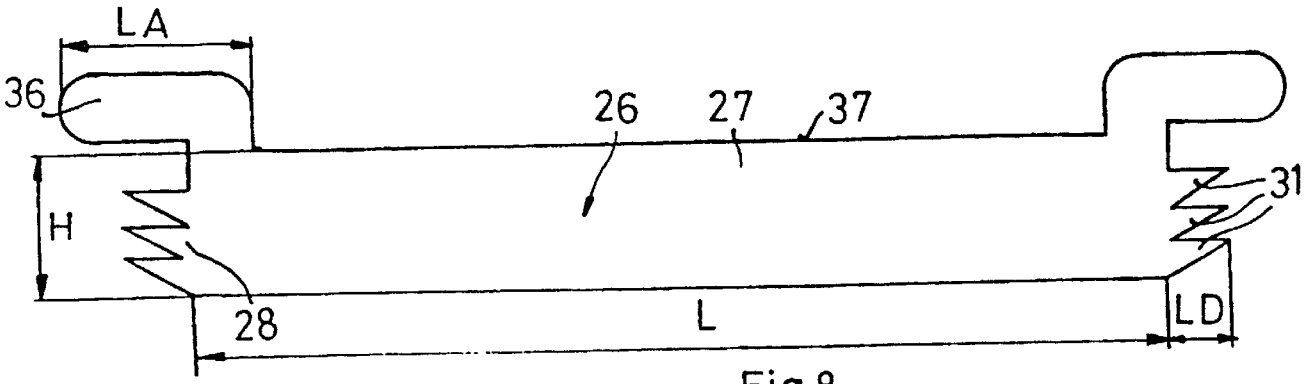
Fig.8
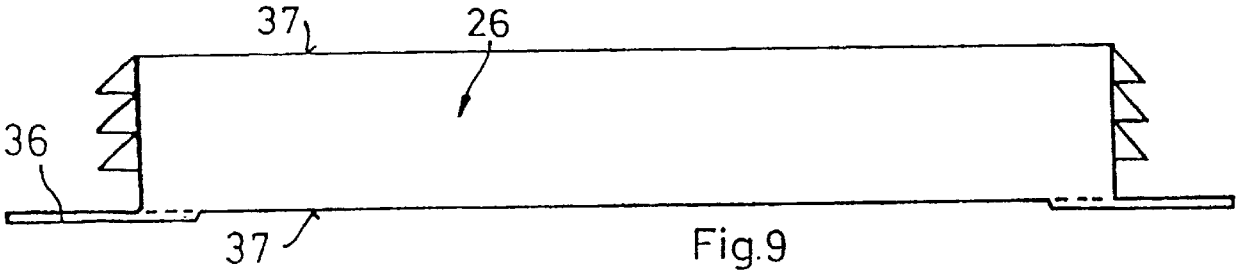
Fig.9
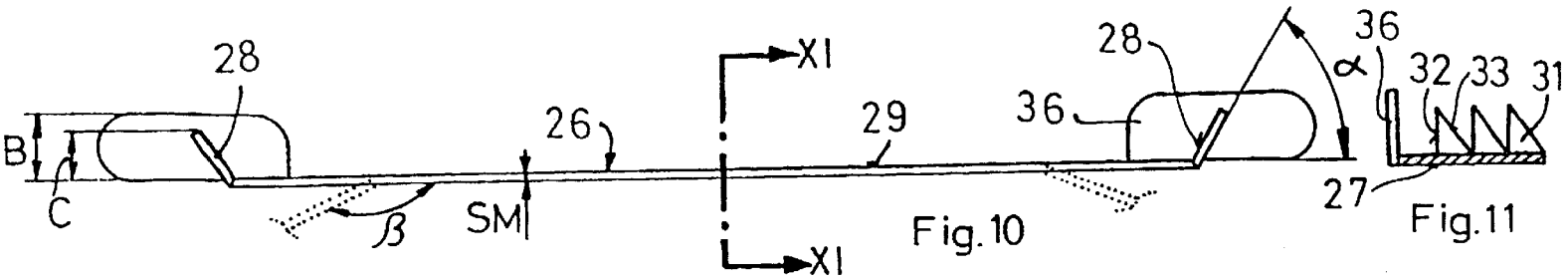
Fig.10
Fig.11

EXPANDABLE ARTISTS' FRAMES AND PRELOADING SPRINGS THEREFOR

FIELD OF THE INVENTION

The present invention is directed to expandable artists' frames and preloading springs therefor.

BACKGROUND OF THE INVENTION

An expandable artists' frame of the kind is disclosed in IT-A-1,031,812 and in the corresponding U.S. Pat. No. 4,050,498.

In this frame the ends of the frame sides are cut at 45° and slidably housed into hollow angular supports, whereby a V-shaped strip-like spring is also housed in the bisecting line of each hollow angular support between the abutting bevelled ends of two adjacent frame sides and tends to bias apart the side ends from each other.

At the ends of said frame sides are also provided longitudinal slots which allow said hollow angular supports to be slidably inserted along said slotted side ends.

Besides a hollow box-like construction, the known angular or L-shaped supports have a number of structural and functional expedients. These include a bisector-like diagonal wall defining inside the hollow support, between the abutting side ends, an air space capable to house a preloading V-shaped spring, and outside the hollow support, a corner filling wall portion capable of supporting the canvas in the corner area, when the bevelled side ends are at a distance from each other, that encompasses all the possible different expansion positions of the artists' frame.

The frames according to the teaching of U.S. Pat. No. 4,050,498 provide a functionally acceptable preloading action onto the canvas fixed to the artists' frame or stretcher. However, the preloading action allows only a limited expansion stroke of the frame sides.

Furthermore, from a manufacturing and handling point of view, the frames present limits and shortcomings.

First of all the artists' frames require four plastics hollow angular supports. The structural and functional expedients of the disclosed hollow angular supports increase the synthetic material costs and require complicated and costly moulds.

Notwithstanding these expedients, the stiffness obtained with the hollow angular supports is limited by an opening at the internal corner of the hollow angular support. This opening is necessary for inserting the respective V-shaped preloading spring.

Furthermore, in order to permit insertion of the spring, the preloading springs require a preliminary closure of the spring legs, practically with an abutment of the legs one against the other, and consequently a strong closing force which can only be applied by means of special tools, so that the V-shaped springs are not suitable for manual introduction by the user.

It is further to be noted, that the preloading force exerted by these known sprigs decreases, that it is determined by the spring dimensions, and that it is not adjustable by the user.

It is further to be pointed out, that the components of these artists' frames, except the canvas and the staples or nails, that is the frame sides, the hollow angular supports and the springs are dimensionally mutually adapted for forming the frame in question, and do not allow the use of single components per se, that is as distinct parts for making, for example, expandable frames of other kinds or sizes. In other words, the single components of the artists' frame disclosed in U.S. Pat. No. 4,050,498 can not be used with expandable frames in general, for example with expandable frames having wedges, which as is known require the machining of appropriate seats or slots for housing the wedges into the frame sides at the respective internal corner.

The arrangement of these known wedges for statically preloading the canvas and the respective seats or slots for housing the wedges can be seen, from example, in U.S. Pat. No. 3,882,616. However, the artists' frame disclosed in this patent is not provided with springs for dynamically preloading the canvas.

The present invention further relates to improved hollow angular supports for expandable frames in accordance with the present invention.

A further expandable frame is disclosed in DE-C-581,549. In this artists' frame, in the respective bevelled opposite ends of adjacent frame sides are provided two opposite cylindrical seats. One seat houses a guiding pin and the other seat houses a compressible helicoidal spring which, in its rest position, holds the abutting side ends apart from each other. In the side ends are further provided two hollow seats for housing the ends of a securing bracket spring, which while acting against the helicoidal spring, holds two respective abutting side ends resting one on top of the other for fixing the canvas onto the frame. After having fixed the canvas, the bracket springs are removed and the helicoidal springs preload the canvas. This artists' frame requires expensive machining operations, a considerable number of components, and the springs do not allow a preloading adjustment.

Furthermore, the frame sides are connected together only by the pins and helicoidal springs so that the frame practically does not have any stiffness, which by contrast is strongly required in artists' frames or stretchers. An expandable artists' frame having corner springs is disclosed in FE-A-2,439,683.

In this frame the frame sides are slidably embraced at their ends from the interior by L-shaped supports having legs with a U-shaped cross section and which are provided at the internal corner of the L-shaped with a quadrangular section. Parallel to the U-shaped support legs is provided a respective helicoidal spring which is inserted onto a screw. The screw is screwed at one end thereof into the quadrangular section, and at the other end is fixed to a bracket, which in turn is fixed to the respectively associated frame side by means of two screws. A nut screwed onto the screw compresses the helicoidal spring, whereby the associated frame side is biased apart from the abutment area of adjacent sides so that a consequent preloading action of the canvas is reached.

This frame requires a large number of components for each frame corner, and the L-shaped supports as well as the screws housing the springs consist of several parts which are welded or riveted together.

The screws holding the springs are in turn fixed to the associated frame sides by two screws. For each frame side thickness, it is necessary to provide L-shaped supports having a corresponding cross section size of the U-shaped legs. The preloading action is indeed adjustable between a minimum and a maximum value by compressing the helicoidal springs. However, a subsequent preloading is not possible. The L-shaped supports cannot cover the air space between two adjacent opposite side ends so that under a strong canvas shrinkage this frame can undergo twists.

SUMMARY OF THE INVENTION

The main object of the present invention is to create expandable artists' frames of the stated kind which eliminate the drawbacks of the known expandable frames and comprise preloading springs which do not require additional components and are capable of co-operating with adjacent frame sides which are mutually connected with whatever coupling arrangements, that is both with slidable groove-and-tongue joints or by means of hollow angular supports, whereby the preloading springs can be easily applied and removed by the user, are adjustable in their preloading force, and can be used per se, that is as distinct springs, for converting known expandable frames into expandable stretchers, which are automatically continuously preloaded by the preloading springs according to the present invention.

In expandable artists' frames with the features recited in the claims, the above object is attained, in accordance with the present invention.

With reference to the preloading springs as parts for completing expandable frames, the above stated object is attained, in accordance with the present invention, with the features set forth in the claims.

Further advantageous embodiments of the expandable frames or stretchers, the preloading springs, as well as hollow angular supports for the expandable frames in accordance with the present invention are set forth in the dependent claims.

The present invention provides a low cost manufacturing of the preloading springs by means of well known blanking and bending operations with conventional equipments, starting from a spring steel strip, whereby the preloading springs do not advantageously require subsequent finishing operations.

In a preferred embodiment, the preloading springs are provided at their ends with positioning and wounding preventing wings which permit an easy and quick positioning of the springs onto the frame, and at the same time protect against wounding during handling and application or mounting of the preloading springs.

Preferably, with specific spring dimensions, it is possible to achieve easy and reliable applications or mounting of the preloading springs in frames of different sizes, as well as optimum preloading actions onto the canvas.

Preferably, the spring wings of the present invention are formed and dimensioned to reliably carry out the double positioning and protection functions.

Preferably, the shape and arrangement of the teeth ensure a reliable and smooth sliding of the spring ends along the frame sides during the mounting or application of the spring, as well as a reliable and automatic anchoring or penetration of the teeth into the wooden sides after stopping the applying or mounting force onto the spring.

It is possible to use improved hollow angular supports which require a reduced consumption of plastics and easy moulding equipments, whereby the support wall does not have any opening or other weakening areas or elements so that the suggested angular supports are capable to confer on the expandable frames a very strong stability against twists, and this also under strong frame contractions caused by the shrinking canvas.

According to the present invention, the use of hollow angular supports for expandable frames are considered advantageous features.

The advantages achieved with the present invention consist in that the elastic preloading of the canvas is obtained by means of only one spring for each frame corner, and in that no components or seats for housing or positioning the preloading springs are necessary in the frame sides. This advantageously allows the use of the preloading springs according to the present invention practically with all kind of expandable frames, that is both with frames having hollow angular supports or not. In the last mentioned case it is also advantageously possible to simplify the manufacturing of the frame sides because the known seats or slots for receiving the expansion wedges are fully eliminated, and also the wedges themselves are superfluous.

Another advantage is that the elastic preloading force acting on the canvas is easily adjustable by the user at any time. A further advantage is to be seen in the easy and automatic positioning of the springs during the mounting thereof as well as in the protection action against woundings thanks to the suggested positioning and wounding preventing wings provided at the spring ends.

After the mounting on the frame the proposed springs do not have any parts projecting from the frame, which advantageously avoids any possible thickness increase, which in turn could prejudice the correct housing of the frame into the respective picture-frames.

Still another advantageous is that the proposed springs allow favorable outline-dimensions which permit the use of only one or at most two spring sizes for a wide range of frame side thickness.

Still another advantage resides in the fact that with the angular supports according to the present invention, it is possible to obtain very rigid and at the same time cheap expandable frames.

BRIEF DESCRIPTION OF THE DRAWINGS

Further advantages will become apparent when reference is made to the following detailed description of the invention and the following drawings in which are shown a prior art artists' frame and preferred embodiments of the expandable frames and components thereof according to the present invention. In the drawings:

FIGS. 1*a*, 1*b*, and 2 to 4 show Figures of the expandable frame disclosed in U.S. Pat. No. 4,050,498;

FIG. 8 is a top view of the spring shown in FIGS. 5 to 7 as a blank obtained from a spring steel strip;

FIG. 9 shows a view of the spring in FIG. 8 after a bending operation, and more exactly rotated 180° along the longitudinal spring axis;

FIG. 10 is a top view of the spring of FIG. 9;

FIG. 11 is a cross section taken along the plane XI—XI in FIG. 10;

DETAILED DESCRIPTION OF THE INVENTION

Figure 5:
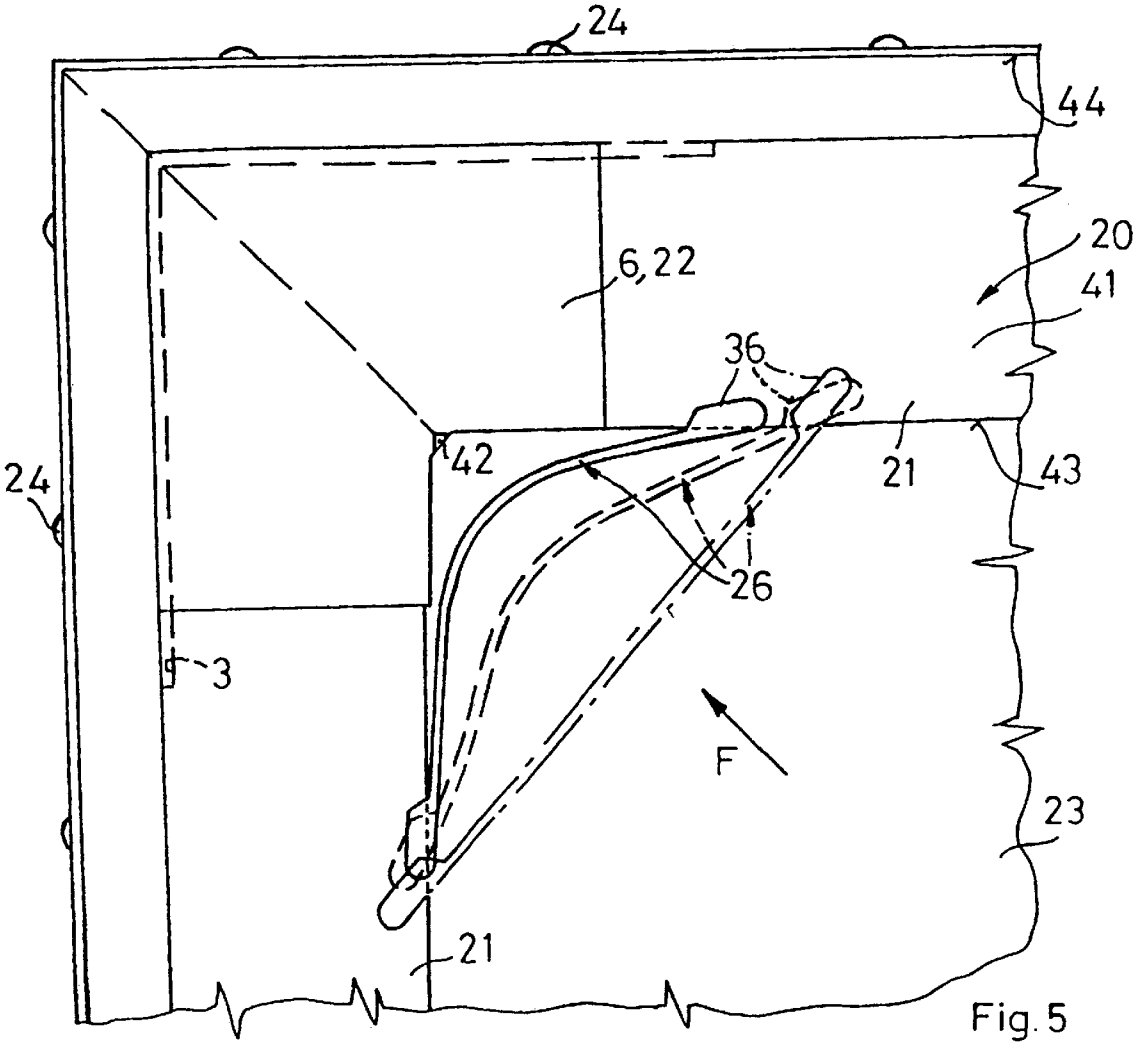
FIG. 5 is a top view of a corner area of an expandable frame according to the present invention with a preloading spring.

Reference is made first to FIGS. 1*a*, 1*b* and 2 to 4 showing the prior art artists' frame disclosed in U.S. Pat. No. 4,050, 498. The frame or stretcher 2 have four frame sides 1 the ends of which are cut at 45° and provided with a respective longitudinal slot 3 for receiving the lateral parts 4 and 5 of a hollow angular support, designed 6.

In FIGS. 1*a* and 1*b* two adjacent side ends 8 and an angular hollow support 6 are shown before and after assembling, as seen from the canvas side, whereby the canvas has been omitted for clarity purposes.

The hollow angular support 6 shown in the perspective view of FIG. 2 has a bisector-like wall 7, 7' against which abut the bevelled side ends 8. These abutting side ends 8 form an air space 9, as seen in the prospective view of FIG. 3. In the air space 9 can be inserted a preloading spring 10 which is V-shaped and has two spring legs 11. The insertion of the V-shaped spring can only be carried out after having preliminary closed the spring legs 11 the one against the other, as shown with dashed line in FIG. 3. An opening 12 is provided in order to allow insertion, at the internal corner of the box-like, L-shaped support 6.

An assembled frame 2 is shown in back view in FIG. 4. This artists' frame as well as its components presents the drawbacks and shortcomings set forth in the appreciation of U.S. Pat. No. 4,050,498 in the introductory part of the description.

Figure 6:
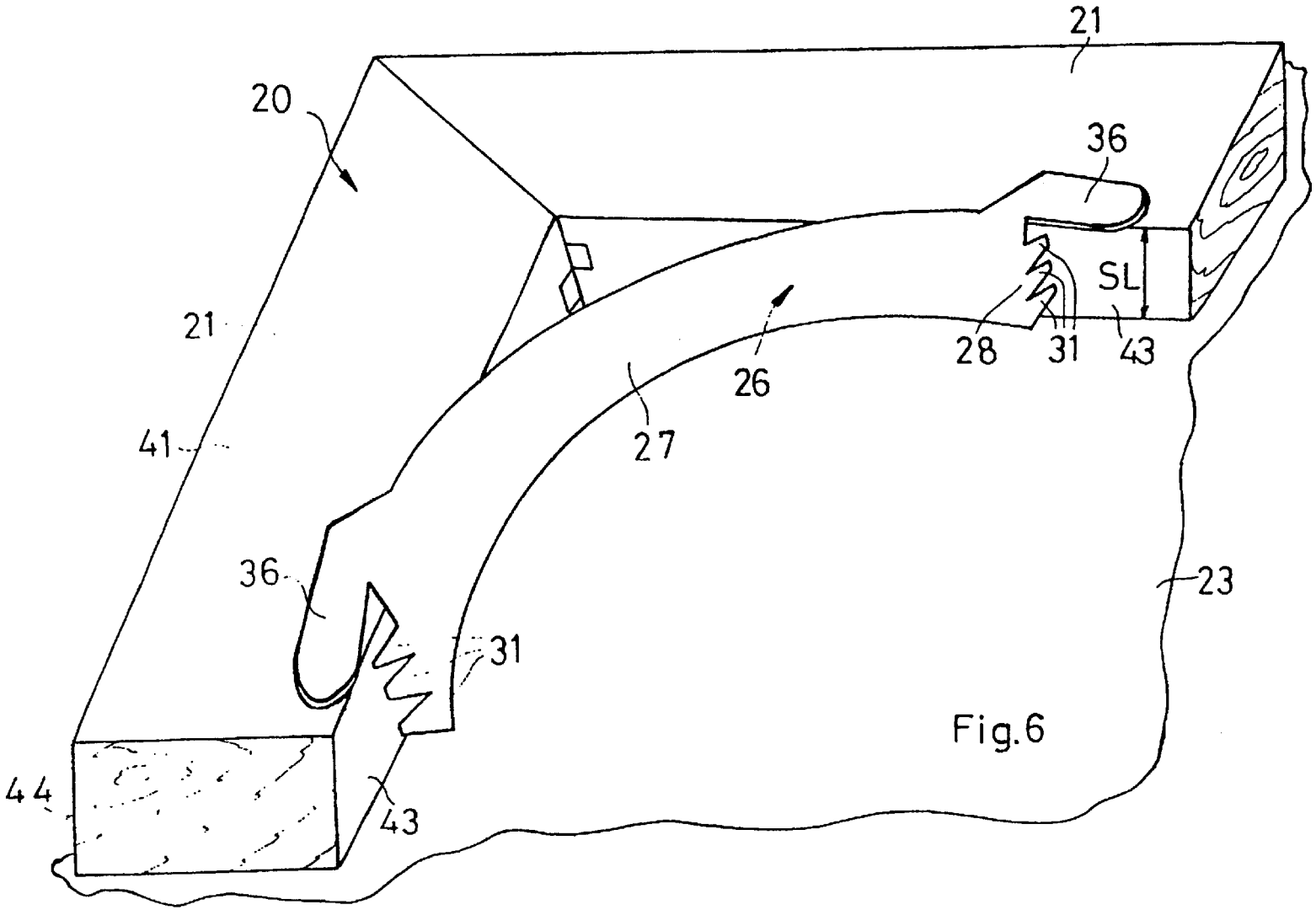
FIG. 6 represent the corner area of FIG. 5 in a prospective view from the rear surface of the frame.

According to the present invention the expandable frame or stretcher 20, FIG. 5, can consists of four frame sides 21 connected at their ends with any type of slidable engagements, for example with a known groove-and-tongue joint, as schematically shown in FIG. 6, or with a hollow angular support 22 according to the present invention as shown in FIG. 5 and further discussed in the following. The choice of the respective slidable connections of the side ends is wholly optional. Onto the frames in accordance with the invention the canvas 23 can be fixed in any suitable manner, for example by means of staples or nails 24.

According to the present invention, springs 26 are provided for preloading the frame canvas. In a preferred embodiment, these springs are obtained from a spring steel strip. No additional fixing components or seats therefor in the frame are provided. The springs 26 have a strip-like middle part or rectilinear, or substantially rectilinear, body 27 with toothed ends 28. After a conventional blanking operation, the toothed or indented ends are bent backwards and form with the spring back side 29 facing the frame 20 an angle alpha, for example comprised between 50° and 70°, preferably of 60°. With these angles, good anchoring penetrations of the teeth points into the wooden frame sides are assured, as further discussed in the following.

The indented or toothed spring ends 28 have teeth 31, preferably sawtoothed-like. Preferably, the teeth 31 have a first side 32 which is parallel or substantially parallel to the longitudinal edges 37 of the spring 26 and a second side 33 which is oblique with respect to the edges 37. With this tooth configuration, the teeth, when sliding on the frames sides during the application or mounting of the spring, exert a leading action which tends to rectilinearly lead the spring ends with respect to the thickness SL or length of the frame sides 21, FIG. 6.

Figure 12:
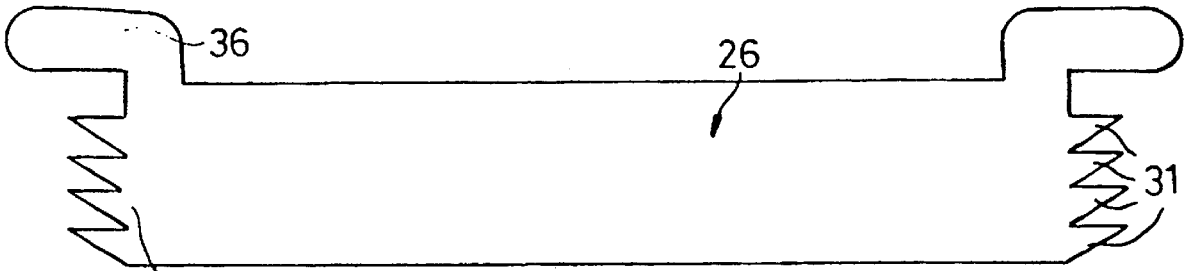
FIG. 12 represents a view similar to that of FIG. 8 of a spring having spring ends with four teeth.

In the embodiments depicted in FIGS. 6 and 8 to 11 each side has three teeth 31 whereas in the embodiment shown in FIG. 12 the spring 26 has spring ends provided with four teeth 31. The springs 26 having four teeth will be used with frame sides having a great thickness SL, that is for frames 20 having greater sizes.

In another preferred embodiment according to the present invention the spring 26 is further provided with end wings 36, as shown in FIGS. 5, 6 and 7 to 12. These wings 36 have a double function, that is a positioning and a protection function, as further discussed in the following.

The end wings 36 are obtained in one piece with the spring body 27 during the blanking of the starting spring steel strip as shown in FIGS. 8 and 12. The shape of the wings can be freely chose. The substantially rectangular form with the rounded corners of the spring wings shown in the drawings permits a reliable execution of the stated functions while maintaining the advantageous one piece construction. The end wings are bent during the blanking-bending operation of the toothed ends 28. In the shown embodiments, the end wings 36 are bent at right angles with respect to the spring body 27, backwards and in a covering position above the toothed ends 28. As can be seen in particular in FIG. 10, the width B of the end wings 36 is larger than the teeth projection c from the spring body 27.

The height H of the spring body 27 can be equal to the thickness SL of the frame sides 21 or even smaller than the thickness SL, FIG. 6.

Figure 7:
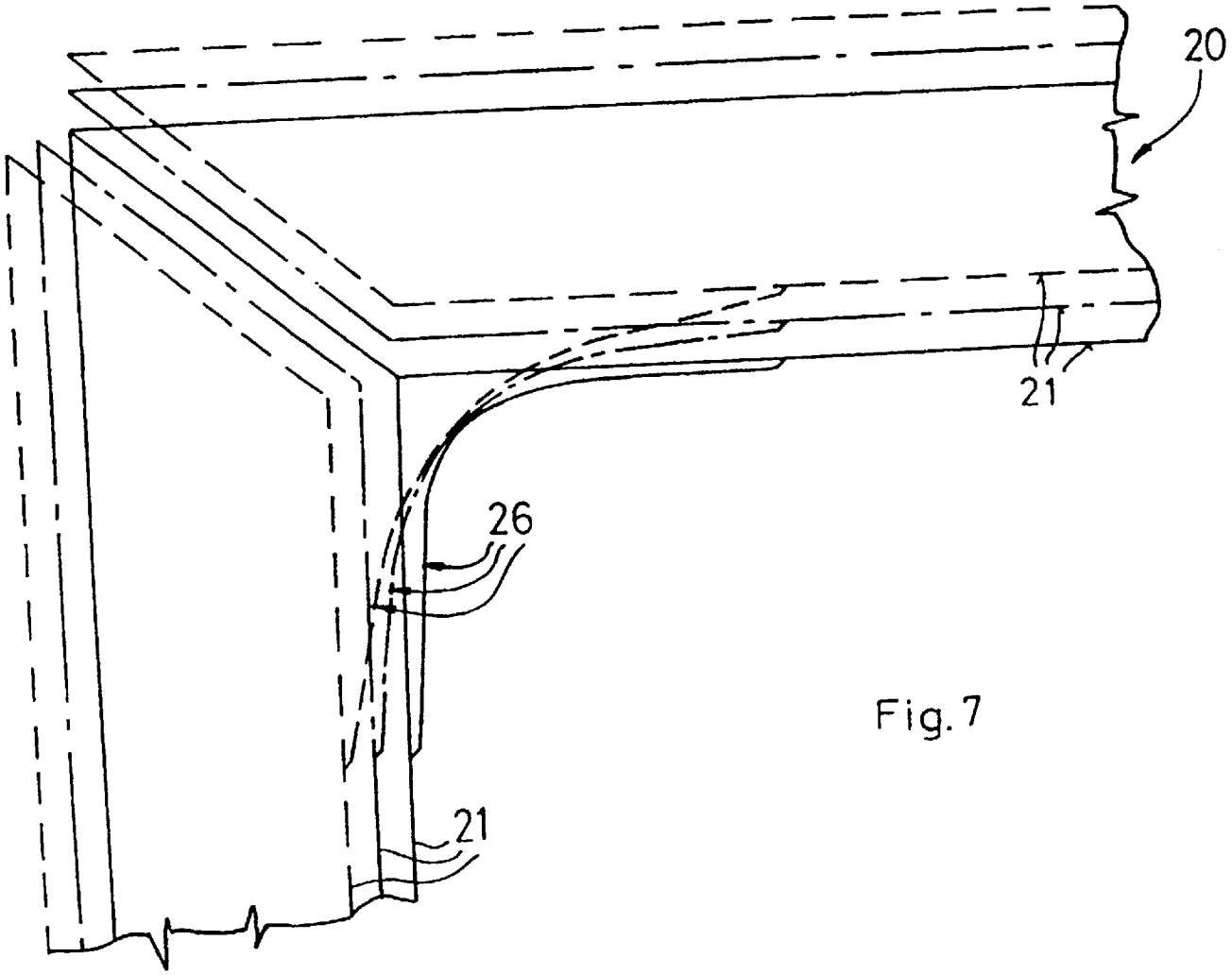
FIG. 7 diagrammatically illustrates a top view similar to that of FIG. 5, however without canvas and with spring and frame sides in different preloading positions.

The preloading of expandable frames or stretchers 20 and the working of the preloading springs 26 according to the present invention are now illustrated with particular reference to FIGS. 5 and 7.

After the conventional fixing of the canvas 23 onto the frame 20, the continuous elastic preloading of the frame, that is of the canvas, takes place by means of the application or mounting of a preloading spring 26 in each frame corner. This is accomplished by first placing, from the rear surface of the frame, a spring 26 in a corner area, and more precisely in a transversal position with the teeth 31 smoothly against the internal surface 43 (FIG. 6) of the frame sides 21, as shown in FIG. 5 with dashed and dotted line. In the case of preloading springs 26 having end wings 36, the latter are placed on the rear surface 41 of the frame sides so that an immediate and reliable positioning of the spring itself, as well as with respect to the thickness SL of the frame sides is achieved. During the handling of the springs 26, the end wings 36 prevent at the same time an unwanted scratching of the fingers against the points of the teeth 31 so that the wings 36 effectively carry out an accident prevention.

After the soft leaning of the spring 26 against the frame sides 21, on the middle part of the spring 26 a force is manually applied towards the internal corner 42 of the corner area of the frame 20, that is in the direction of the arrow F, whereby the force causes an arch-like convex bending of the spring with simultaneously sliding of the spring teeth 31 along the internal surfaces 43 of the frame sides 21. Of all the intermediate bending positions of the spring 26 during the application or mounting thereof FIG. 5 only illustrates a middle position, with a dashed line, and a possible end position. When the wanted spring end position is reached, as shown for example by the full line in FIG. 5, the pressure onto the spring 26 is abandoned and the elastic spring preloading which is transmitted by the toothed ends 28 of the spring 26 to the frame sides 21 will immediately cause a partial penetration of the teeth 31 into the sides 21 with a double action, that is the stable self-anchoring of the spring 26 int other sides 21, and the continuous transmission of the elastic preloading onto the frame sides 21 and therefore onto the canvas 23.

At this point it is apparent that the user or artist can adjust as desired the intensity of the deformation or preloading thrust on the spring 26, and consequently he can adjust as desired the tensioning transmitted to the canvas 23.

In case of canvas yieldings, which can take place, as is known, while drying the moisture adsorbed by the canvas from the colors or the environment atmosphere, the preloading of the springs 26 will encounter a smaller resistance by the canvas and consequently the springs will deform themselves by opening themselves. In such case, they will expand themselves, that is they will push apart the frame sides 21 a greater amount, as shown in principle in FIG. 7 with reference to two subsequent expansion stages illustrated with dashed line and dashed and dotted line, respectively.

In the case of remarkable canvas yieldings, with a consequent practical integral relief of the elastic preloading of the springs 26, the latter will considerably lose their efficiency. However, under such circumstances the present invention, differently from the prior art expandable frames and springs, permits to apply again the desired preloading onto the canvas. For this purpose a compression force in the direction of the arrow F is again applied on the spring, which is now bent with a large arch, in the same manner as described above for the application or mounting of the springs.

In order to limit the smallest bending curve of the mounted springs 26, the ends of the spring body 27 could be advantageously bent with an angle beta of, for example, 140° to 170°, preferably of 160°, with respect to the spring body 27, and more precisely opposite the spring back side 29, as shown by the dotted line in FIG. 10.

The preloading springs according to the present invention are preferably blanked by a spring steel strip and bent and subsequently hardened or tempered in a conventional manner to a convenient degree.

Very good results in tensioning canvases of natural and synthetic fibres, as well as on frames with different sizes and different types of slidable side connections have been attained, as well as with frames having hollow angular supports by using strip-like springs with the following dimensions:

length L of the spring body 27: from 70 to 90 mm, preferably 80 mm, height H of the spring body 27: from 8 to 20 mm, preferably 13 or 15 mm, thickness SM of the spring strip: from 0.5 to 0.7, preferably 0.6 mm, length LD of the spring teeth 31: from 3 to 7 mm, preferably 5 mm, angle alpha: from 50° to 70°, preferably 60°, and in the embodiment with positioning and protection end wings, length LA of the spring wings 36: from 10 to 20 mm, preferably 15 mm, width B of the spring wings 36: from 3 to 7 mm, preferably 5 mm.

Figure 13:
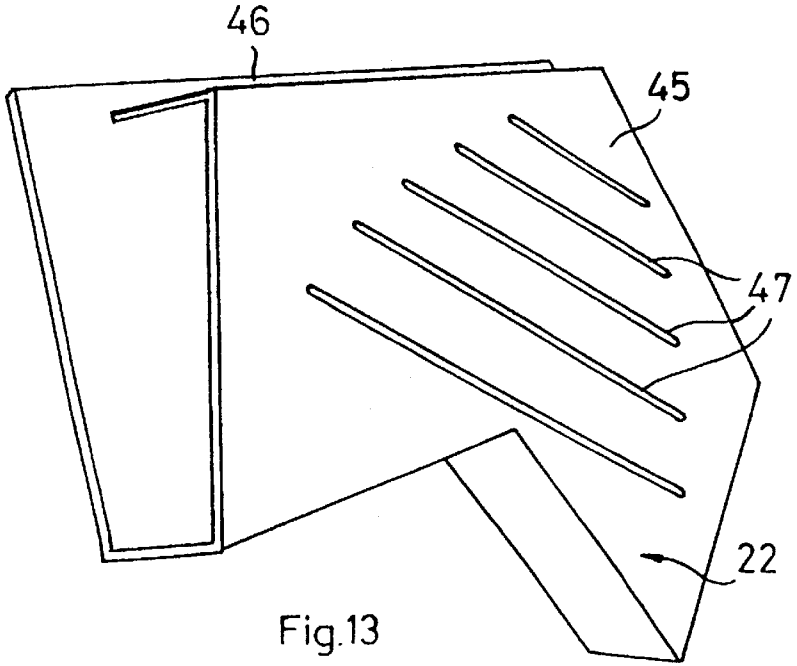
FIG. 13 is a perspective view of an improved hollow angular support for expandable frames according to the present invention.

According to the present invention it is possible to obtain particularly simple and twist rigid frames employing improved hollow supports 22 which are structurally simplified and without any wall openings, as shown in FIG. 13. The box-like support 22 shown in FIG. 13 presents a L-shaped configuration with a continuous wall 45 which does not have any openings. A bisector-like partition wall is not provided. On the bottom wall is advantageously provided a covering flange 46, which projects for only a small degree and serves only for aesthetic purposes, that is for covering the known longitudinal slots 3 at the side ends.

The numeral reference 47 denotes stiffening ribs, which can be provided in a number and with a development as desired, on one or both the large surfaces of the hollow improved support 22.

From the foregoing it will be readily apparent that the springs 26 according to the present invention are capable of being used per se—that is without additional components—, with already existing expandable frames. Consequently, an autonomous protection for the springs, as well as for the use thereof is required.

It forms part of the scope of the invention to provide springs with a light curved body or with a body in the form of an open ring with toothed ends as set forth above, even if these embodiments require a greater amount of material.

The springs according to the present invention can also be used in corners formed between the frame sides 21 and the known, not shown, stiffening cross-like reinforcements or diagonals of frames with large sizes, so that the latter can also be preloaded according to the teaching of the present invention and fall therefore within the scope of the invention.

What is claimed is:

1. An expandable artists' frame for supporting a canvas laid perimetrically thereon, the frame comprising:

a plurality of frame sides and a plurality of frame corners, the frame sides being connected together at their ends by joints to form one of said frame corners;

each frame side having an external side surface for fixing the canvas thereto, and an opposite internal side surface;

a strip-like spring member disposed at each frame corner;

said spring member elastically biasing apart two adjacent frame sides;

each spring member having a spring front side and a spring back side, a spring bod y which in a rest state is substantially rectilinear, and toothed ends bent towards the spring back side a t an angle alpha;

said toothed ends being structured and arranged to directly engage the internal side surfaces of two adjacent frame sides under a preloading action resulting from applying a respective spring member in a respective frame corner.

2. The expandable artists' frame ,according to claim 1, wherein the joints are groove and tongue joints.

3. The expandable artists' frame according to claim 1, wherein the joints comprise hollow angular supports.

4. The expandable artists' frame according to claim 1, wherein the spring members have on their upper longitudinal edge end wings which extend at a right angle with respect to the spring body towards the spring backside, said end wings having a width greater than a protrusion dimension of the underlying projecting teeth thereby to act simultaneously as positioning and protection wings.

5. The expandable artists' frame according to claim 4, wherein the spring members have the following dimensions:

a spring body length ranging from 70 to 90 mm;

a spring body height ranging from 8 to 20 mm;

a spring strip thickness ranging from 0.5 to 0.7 mm; and wherein the spring teeth have a length ranging from 3 to 7 mm, and the angle alpha ranges from 50 to 70°.

6. The expandable artists' frame according to claim 5, wherein the end wings are obtained in one piece from the spring strip itself and have the following dimensions:

a length ranging from 10 to 20 mm; and a width ranging from 3 to 7 mm.

7. The expandable-artists' frame according to claim 1, wherein the toothed ends comprise at least three teeth, each tooth having a first side which is substantially parallel to longitudinal edges of the spring body, and a second side which slants with respect to said longitudinal edges of the spring body.

8. The expandable artists' frame according to claim 1, wherein the spring body has ends which are bent at an angle beta ranging from 140° to 170° with respect to the spring body opposite to the spring back side.

9. The expandable artists' frame according to claim 1, wherein the joints comprise hollow angular supports, which have a continuous wall structure without openings.

10. The expandable artists' frame according to claim 9, wherein the hollow angular supports include a small covering flange for covering longitudinal slots on said frame sides, said hollow angular supports having at least one surface provided with stiffening ribs.

* * * * *